US010925128B2

(12) United States Patent
Zhang et al.

(10) Patent No.: US 10,925,128 B2
(45) Date of Patent: Feb. 16, 2021

(54) CURRENT TUNEBACK IN LIGHT EMITTING DIODE LUMINAIRES

(71) Applicant: Eaton Intelligent Power Limited, Dublin (IE)

(72) Inventors: Hui Zhang, Manlius, NY (US); Joseph Michael Manahan, Manlius, NY (US)

(73) Assignee: Eaton Intelligent Power Limited

( * ) Notice: Subject to any disclaimer, the term of this patent is extended or adjusted under 35 U.S.C. 154(b) by 0 days.

(21) Appl. No.: 15/618,966

(22) Filed: Jun. 9, 2017

(65) Prior Publication Data

US 2017/0359876 A1 Dec. 14, 2017

Related U.S. Application Data

(60) Provisional application No. 62/348,389, filed on Jun. 10, 2016.

(51) Int. Cl.
*H05B 45/10* (2020.01)
*H05B 45/50* (2020.01)
*H05B 47/19* (2020.01)

(52) U.S. Cl.
CPC ..... *H05B 45/10* (2020.01); *H05B 45/50* (2020.01); *H05B 47/19* (2020.01)

(58) Field of Classification Search
CPC ..... H05B 33/083; H05B 33/0854; H05B 33/0803; H05B 33/0815; H05B 33/0845; H05B 33/089; H05B 33/0812; H05B 33/0851; H05B 33/08; H05B 33/0806; H05B 33/0809
USPC .... 315/291, 185 R, 112, 117, 158, 307, 113, 315/118
See application file for complete search history.

(56) References Cited

U.S. PATENT DOCUMENTS 9,084,306 B1 * 7/2015 Bohler ..... H05B 45/10
9,242,550 B2 * 1/2016 Thompson ..... B60K 15/03177
2006/0001381 A1 * 1/2006 Robinson ..... H05B 33/0815 315/185 R (Continued)

FOREIGN PATENT DOCUMENTS

KR 10-2013-0011529 A 1/2013
KR 10-2015-0116496 A 10/2015
WO 2015/097476 A2 7/2015

OTHER PUBLICATIONS

Author: Michael King, Title: Hazardous area lighting, temperature considerations, new protection methods, technology and illumination, Date:Oct. 29, 2007, pp. 1-14.*

(Continued)

*Primary Examiner* — Wei (Victor) Y Chan
(74) *Attorney, Agent, or Firm* — Merchant & Gould P.C.

(57) ABSTRACT

Safety improvements to Light Emitting Diodes (LED) are discussed herein. As the LEDs that are part of a luminaire heat up and cool down, the current supplied will be tuned to improve the safety of the luminaire to manage the levels of light and heat produced. At least one thermally active electrical component is incorporated into the LED load of the luminaire, which is communicated to an LED current control to signal when to adjust current levels providing by a driving circuit. Current is reduced when the temperature of the LED load exceeds a threshold, and or returned to an optimal current when the temperature no longer exceeds the threshold.

22 Claims, 3 Drawing Sheets

(56) References Cited

U.S. PATENT DOCUMENTS

2007/0041185 A1* 2/2007 Yatsuda ..... F21K 9/00 362/231
2007/0108843 A1* 5/2007 Preston ..... H05B 45/48 307/112
2011/0031888 A1 2/2011 Datta et al.
2011/0193491 A1* 8/2011 Choutov ..... H05B 45/00 315/291
2011/0241548 A1* 10/2011 Tsai ..... H05B 33/0842 315/117
2012/0113164 A1* 5/2012 Furukawa ..... G09G 3/3426 345/690
2012/0146548 A1* 6/2012 Campbell ..... H05B 45/10 315/297
2012/0306370 A1* 12/2012 Van De Ven ..... H05B 33/0866 315/113
2014/0015421 A1* 1/2014 Mituyasu ..... H05B 33/08 315/158
2014/0021884 A1 1/2014 Fetterly et al.
2014/0333229 A1* 11/2014 Saes ..... H05B 33/0812 315/307
2015/0002025 A1* 1/2015 Maricic ..... H05B 45/10 315/151
2015/0097488 A1* 4/2015 Smith ..... H05B 45/50 315/113
2016/0081147 A1* 3/2016 Guang ..... H05B 33/0803 315/123
2016/0338171 A1* 11/2016 Bhagat ..... H05B 33/0845

OTHER PUBLICATIONS

International Search Report and Written Opinion for Application No. PCT/US2017/036761 dated Sep. 22, 2017.
Extended European Search Report for Application No. 17811084.7 dated Nov. 21, 2019.
Low-Power Linear Active Thermistor™ ICs, MCP9700/9700A MCP9701/9701A, Microchip Technology Inc., pp. 1-20 pages (Jul. 2014).

* cited by examiner

CURRENT TUNEBACK IN LIGHT EMITTING DIODE LUMINAIRES

CROSS-REFERENCE TO RELATED APPLICATION

The present disclosure claims benefit from U.S. Provisional Patent Application No. 62/348,389 filed on Jun. 10, 2016, the disclosure of which is incorporated herein in its entirety.

BACKGROUND

A Light Emitting Diode (LED) is an electrical component that emits light when a suitable voltage is applied across its leads. Luminaires may include one or more LEDs in a form factor suitable for various applications. For example, a luminaire may be shaped like an incandescent lightbulb or fluorescent filament to fit the lamps and light fixtures in a home or office. Luminaires may also be designed for use in industrial environments, where caustic chemicals, flammable materials, extreme temperatures, or combinations thereof may be present at a greater frequency than in the home or office. Several industrial standards are in place to ensure that the luminaire does not become a danger in various environments (e.g., provide reactants to caustics, become a flashpoint around flammable materials, warp under temperature). These standards often require pass/fail testing when the tested device is initially constructed, but inherent failure modes of some LED devices may result in unanticipated risks, which may lead to safety related events such as fire and explosion during or after installation.

SUMMARY

The present disclosure is directed to systems, devices, and methods for improving the safety of Light Emitting Diode (LED) luminaires through active tuning of the drive current to the LED. By measuring the heat of an LED load with a thermally active electrical component, a current controller may adjust the current running through the components of the LED load, and thereby reduce the heat produced via resistive losses when heat is building up, and allow the LED load to cool to acceptable levels.

The above summary is not intended to describe each aspect or every implementation. A more complete understanding will become apparent and appreciated by referring to the detailed description in conjunction with the accompanying drawings, and that the scope of the present disclosure is set by the claims.

BRIEF DESCRIPTION OF THE DRAWINGS

The accompanying drawings, which are incorporated in and constitute a part of this disclosure, illustrate various aspects of the present disclosure. The drawings are not necessarily to scale. Like numbers used in the drawings refer to like components, however, it will be understood that the use of a number to refer to a component in a given drawing is not intended to limit the component in anther drawing labeled with the same number. In the drawings.

DETAILED DESCRIPTION

Figure 1A:
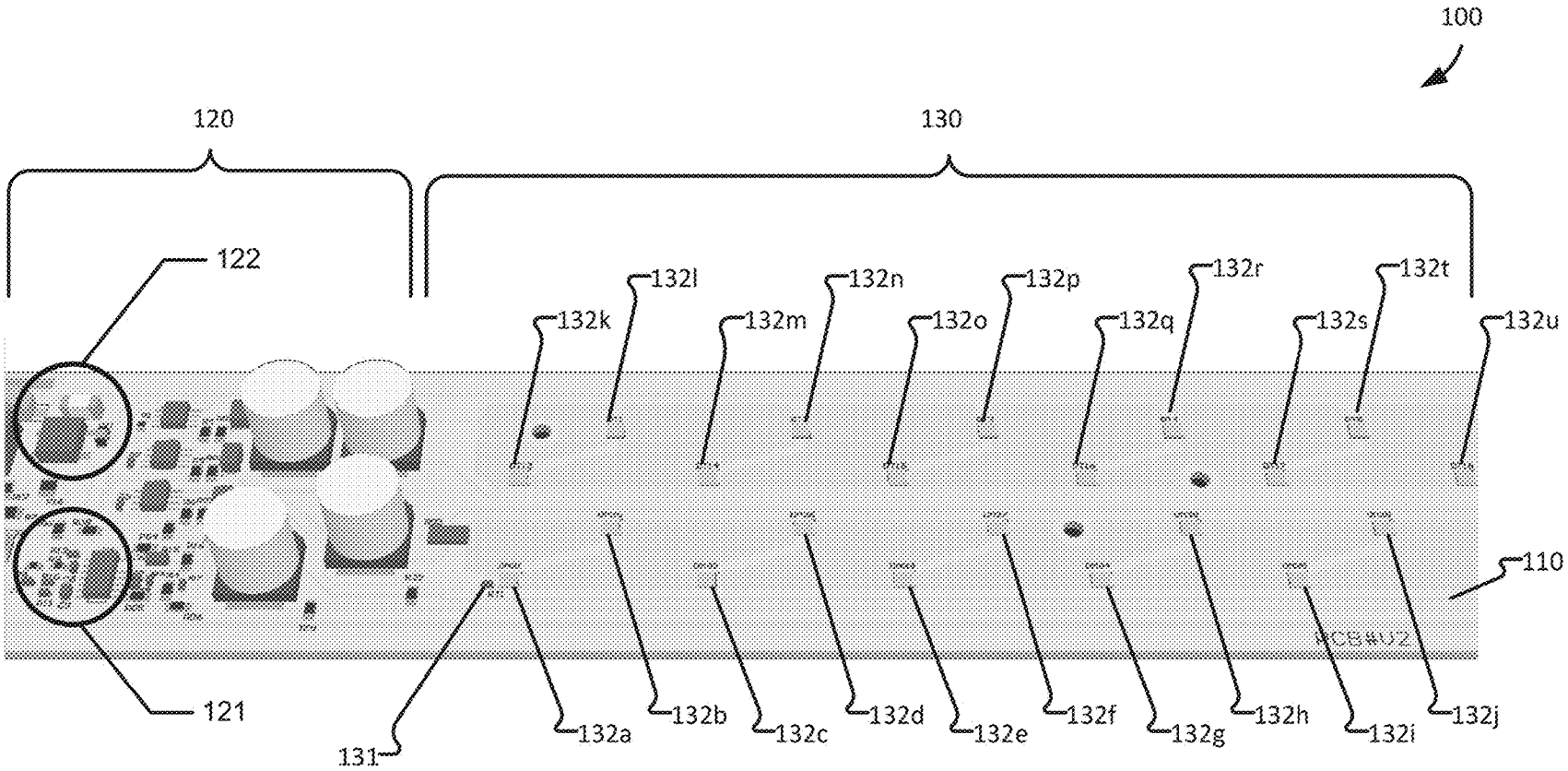
FIG. 1A illustrates an example LED luminaire.

Various examples will be described in detail with reference to the drawings, wherein like reference numerals represent like parts and assemblies throughout the several views. Any examples set forth in this disclosure are not intended to be limiting and merely set forth some of the many possible ways for implementing the broad inventive aspects disclosed herein.

A Light Emitting Diode (LED) is an electrical component that converts the energy supplied in electrical current into light via electroluminescence. As will be appreciated, as current runs through (non-superconductive) electrical components, such as LEDs, a portion of the energy in the current is converted to heat via the component's resistance. This heat is radiated to the surrounding components and environment, and may build up in the component, making it hotter, if the energy supplied to the component produces more resistive heat than the component can dissipate in a given period of time. To keep a component within a specified temperature range, heatsinks, fans, cooling ducts, and the like can improve the ability of a component to dissipate heat to the environment, or the current running through a component may be reduced to thereby reduce the heat needed to be dissipated. As will be appreciated, keeping a component or fixture within a given temperature range may improve the safety of the electrical device (e.g., reducing the likelihood that the device may act as an ignition source), the longevity of the components of the fixture (e.g., reducing the likelihood of burning a component out), and help devices meet industrial standards for use in a greater variety of settings (e.g., a luminaire deemed safe for use in a home environment may not meet a safety standard for use in a coal mine without additional heat controls). Moreover, depending on the failure mechanism of the luminaire, when a subset of the device (e.g., a die in a multi-die device) fails, current from the failed portions may be driven through the portions that have not yet failed, which can increase the overall heat in the device (or the operable portions thereof) and can lead to accelerated failure of the still-operable portions and/or safety hazards.

To adapt a luminaire to a hazardous environment, the LEDs may be isolated from the environment by an air-tight casing including a non-reactive material (e.g., silicone or glass) through which the LEDs will shine. The casing may be clear or colored, and may be impact resistant or made of a shatter proof material. Additional heatsinks, arc suppression, and interlock features may also be included so that when the luminaire is active in a hazardous environment, no ignition or reaction sources will be exposed to the environment.

FIG. 1A illustrates an example LED luminaire 100. In the example LED luminaire 100, several components are disposed of on a Printed Circuit Board (PCB) 110, although one of ordinary skill in the art will appreciate that the components shown may be communicated together without the PCB 110 (e.g., on a breadboard, via direct wiring), and that more or fewer components than illustrated in FIG. 1 may comprise an LED luminaire 100, and that different arrangements of components than shown in FIG. 1 are possible. The example LED luminaire 100 is provided as a non-limiting example.

The example LED luminaire 100 is illustrated in two sections; the driving circuit 120, including a current controller 121 and a rectifier 122, and the LED load 130, including a temperature sensor 131 and LEDs 132*a-u* (generally, LEDs 132). Although both sections are illustrated as being disposed of on the same PCB 110, one of ordinary skill in the art will recognize that the driving circuit 120 and LED load 130 may be disposed of on separate PCBs 110, and that a single driving circuit 120 may be communicated to several LED loads 130.

The driving circuit 120 includes a current controller 121 and a rectifier 122. The current controller 121 controls the level of current provided from an alternating current power source (not illustrated), and the rectifier 122 converts alternating current into direct current for use by the LED load 130. In aspects that use a direct current power source (e.g., a battery) instead of an alternating current power source, the current controller 121 controls the level of current provided from the direct current power source and the rectifier 122 may be omitted or bypassed. In various aspects, the rectifier 122 may be of various configurations and contain components of various values depending on the design specifications and use cases expected of the example LED luminaire 100, and one of ordinary skill in the art will be familiar with the construction of a rectifier 122 to meet the needs of a given LED luminaire 100.

In various aspects, the current controller 121 includes a microprocessor that processes signals according to stored instructions (e.g., burned into the microprocessor, stored as Electrically Erasable Programmable Read-Only Memory (EEPROM)) to affect a level of current provided to the LED load 130. In other aspects, the current controller 121 includes a series of logic gates that control switches that will open and close in response to signals received from the LED load 130 to raise or lower current levels transmitted to the LED load 130. Changes to the level of current provided to the LED load 130 may be accomplished with a dimming functionality, allowing the LED load 130 to produce less light with less current, or with a switching functionality, temporarily cutting off current to an LED load 130 or a portion of the LEDs 132 in an LED load 130. For example, the current controller 121 may temporarily restrict the flow of current to the LEDs 132 (turning them off when current reaches zero or a cutoff for LED operation) until the heat of the LED load 130 drops below a threshold. In another example, a first LED load 130 has its current set to zero until the first LED load 130 cools below a threshold temperature, but a second LED load 130 is provided current. The thresholds may be set via various standards bodies according to various standards (e.g., Underwriters Laboratories (UL), the Institute for Electrical and Electronic Engineers (IEEE), European Conformity (CE), China Compulsory Certificate, (CCC)) for the temperature of the luminaire in-use, which one of ordinary skill in the art will be able to apply.

The LED load 130 includes at least one temperature sensor 131 and at least one LED 132. The temperature sensor 131 is communicated with the current controller 121 so that the temperature of the LED load 130 can be reduced via the regulation of current transmitted to the LED load 130.

In various aspects, the temperature sensor 131 is a thermistor, a thermocouple, a resistance temperature detector (RTD), or an infrared (IR) photodiode. In some aspects, where the resistance of the temperature sensor 131 changes in relationship with temperature, a reference current of a value known to the current controller 121 is fed through the temperature sensor 131 so that the current controller 121 can measure a change in resistance (via changes in voltage across the temperature sensor 131) that indicates a temperature of the LED load 130. In some aspects, the reference current supplied to the temperature sensor 131 may be the operating current of the LEDs 132 that the current controller 121 adjusts to affect the temperature of the LED load 130, while in other aspects a separate current is provided so that if the operating current is modified (or set to zero) the reference current will remain constant.

In aspects where more than one temperature sensor 131 is provided, multiple temperature sensors 131 may be associated with the same LED load 130 or with multiple LED loads 130. The current controller 121 may average the readings from the multiple temperature sensors 131 or use the maximum value received from a temperature sensor 131 when the multiple temperature sensors 131 are on one LED load 130, but will treat the readings from multiple temperature sensors 131 from multiple LED loads 130 separately to manage the heat of each LED load 130 separately. Readings may be averaged by using a shared lead of a microprocessor in communication with multiple analog temperature sensors 131 wired in parallel, a bitwise averaging circuit (e.g., an Adder and a bit-shift register) when using digital temperature sensors 131, or by other means known to those of ordinary skill in the art. Additionally or alternatively, another algorithm besides averaging may be used to collect and smooth cumulative readings over a period of time. Contrarily, readings may be separated by using different leads of a microprocessor (or separate sets of logic gates) to receiving readings.

Figure 1B:
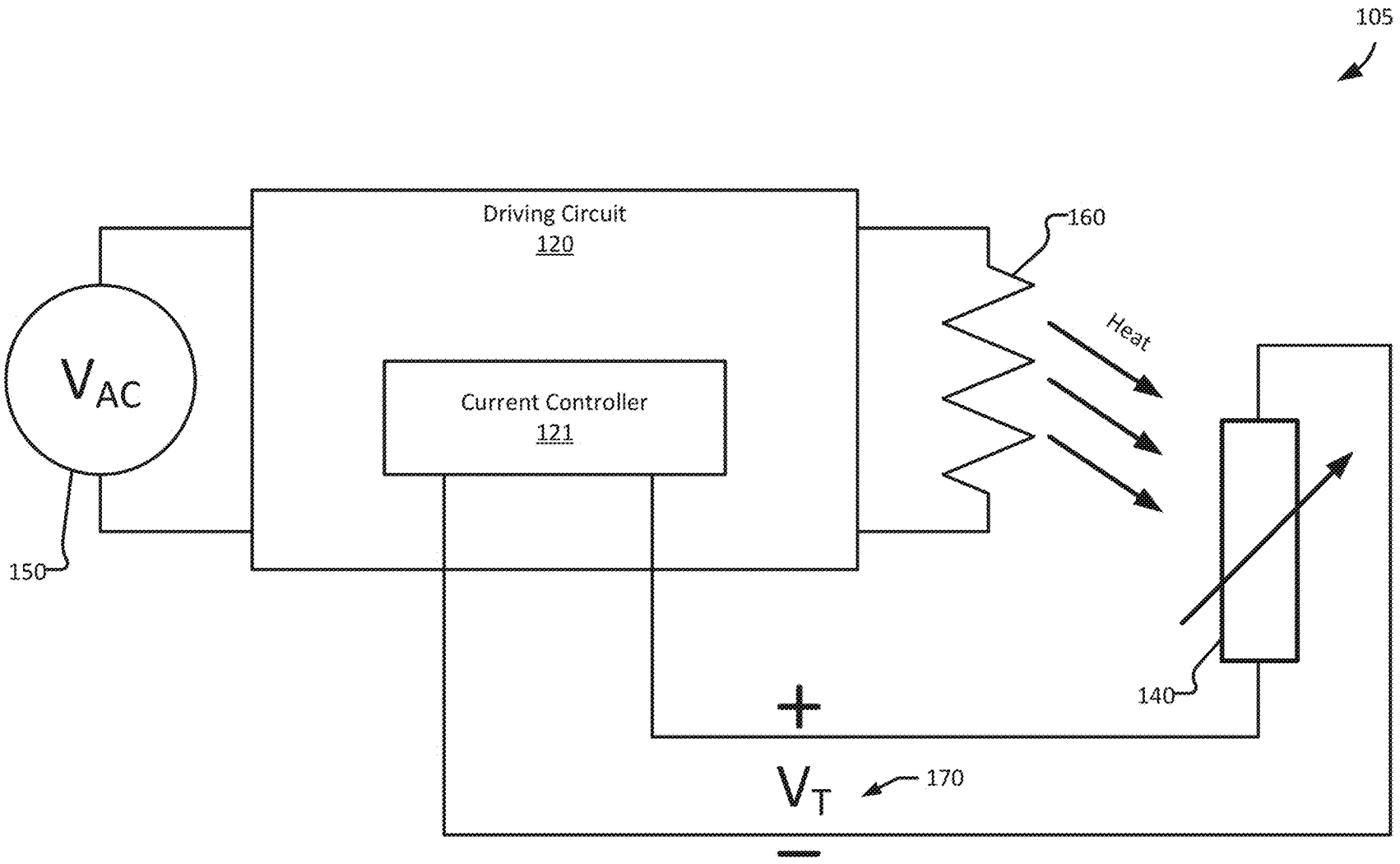
FIG. 1B is a circuit diagram for an example tuneback circuit for an LED luminaire.

FIG. 1B is a circuit diagram 105 for an example tuneback circuit for use in an LED luminaire 100. As illustrated, a resistor 160, representing the resistance of the LED load 130 of at least one LED 132, and a thermistor 140, representing a temperature sensor 131 that has different resistances at different temperatures, are in thermal communication with one another. As current flows through the resistor 160, the thermistor 140 may begin to heat up in response, and its resistance will change. The current controller 121 measures the voltage $V_T$ 170 across the thermistor 140 to track the change in resistance corresponding to changes in its temperature. For example, by applying a constant current to the thermistor 140 and comparing $V_T$ 170 to a base or a threshold value, the current controller 121 can determine when the thermistor 140 has reached a given resistance (and therefore a given temperature) indicating that the LED load 130 will have similarly reached or exceeded a given temperature threshold. Once the current controller 121 has determined that the LED load 130 has reached or exceeded a temperature threshold via the corresponding changes to $V_T$ 170, the driving circuit 120 will be signaled to adjust the current provided to the LED load 130 to ensure the proper and safe continued operation of the LED luminaire 100.

In some aspects, when an overheat threshold is reached, some or all of the LEDs 132 comprising the LED load 130 may be switched off, the current from the AC power source 150 may be reduced, a secondary string of LEDs 132 may be activated instead of a primary string of LEDs 132, a cooling apparatus (e.g., a fan, a vent, a heat pump) may be provided power, etc. In other aspects, when a cooldown threshold is reached, such as when the actions taken in response to an overheat threshold are deemed effective and the LED luminaire 100 can safely resume normal operations, some or all of the LEDs 132 comprising the LED load 130 may be switched on, a primary string of LEDs 132 may be activated instead of a secondary string of LEDs 132, the current provided from the power source 150 may be increased (up to a nominal value), a cooling apparatus may be turned off, etc.

Figure 2:
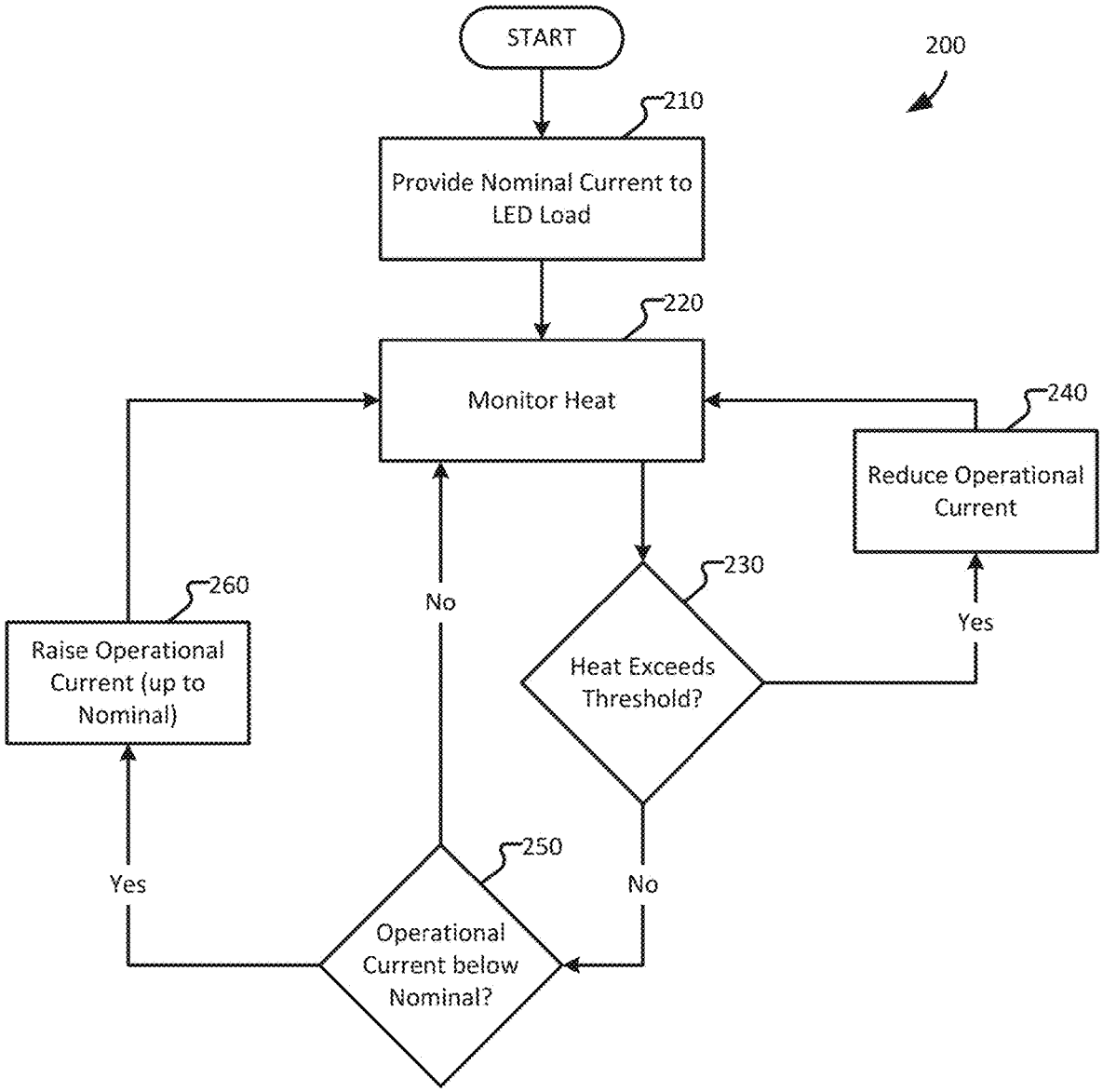
FIG. 2 is a flow chart showing general stages involved in a method for implementing current tuneback in an LED luminaire.

FIG. 2 is a flow chart showing general stages involved in a method 200 for implementing current tuneback in an LED luminaire 100. Method 200 begins at OPERATION 210, where a nominal current is provided to the LED load 130 of an LED luminaire 100 when a power source is applied (e.g., a user flips a light switch associated with the LED luminaire 100). The nominal current is the current that the LED luminaire 100 is designed to provide to the LED load 130 to produce the requested amount to light from the LEDs 132. For example, an LED luminaire 100 may be designed to provide 100% of rated light when 50 mA are provided to the LED load 130, and when a user selects a dimmer function of the LED luminaire 100 for 50% of rated light, 25 mA are provided to the LED load 130. In the preceding example, the currents of 50 mA and 25 mA are both nominal currents for 100% light rating and 50% light rating respectively, although one of ordinary skill in the art will recognize that the numbers in the above example have been simplified to clearly present the concept of a nominal current.

Method 200 proceeds to OPERATION 220, where heat is monitored. Depending on the number and arrangement of temperature sensors 131, the current controller 121 may measure an average, a maximum, or several temperature readings from the LED load 130. In various aspects, the temperature readings may be polled from the sensors or received in real-time. To prevent spikes in readings, in various aspects the multiple readings from one temperature sensor 131 (or group of related temperature sensors 131) may be averaged over a time period or another algorithm may be applied to adjust the level of current provided to the LED load 130 based on the cumulative temperature data from one or more temperature sensors 131.

These temperature readings are compared to a threshold at DECISION 230 to determine whether the temperature exceeds the threshold. When the reading exceeds a threshold, method 200 proceeds to OPERATION 240. When the reading does not exceed the threshold, method 200 proceeds to DECISION 250.

At OPERATION 240, the operational current is reduced by the current controller 121. As will be appreciated, when the current controller 121 reduces the operational current in steps (e.g., 100% to 75% to 50% to 25% to 0%), multiple temperature thresholds may exist so that the current controller 121 may adjust the operational current in accordance with the steps. Steps may be even (n % steps), or uneven, or set to grow/shrink (e.g., 100% to 90% to 70% to 40% to 0%). When the current controller 121 adjusts the operational current in a continuum according to the temperature sensor 131 (e.g., an analog reading from the temperature sensor 131 produces an analog reduction in the operational current) the threshold may be a cutoff value (voltage or current) before which no adjustments to the operational current will be made.

In various aspects, a cutoff value may be supplied by a diode breakdown or avalanche, switches, or the sensitivity of the current controller 121. Method 200 then returns to OPERATION 220 to continue monitoring the heat of the LED load 130.

In aspects where there are multiple temperature sensors 131 associated with different LED loads 130, the current controller 121 may adjust the current supplied to the LED load(s) 130 so that each LED load 130 is affected individually by an associated temperature sensor 131 (e.g., a first temperature sensor 131 or group thereof affects the current supplied to a first LED load 130), is affected mutually by an unassociated temperature sensor 131 (e.g., a second temperature sensor 131 associated with a second LED load 130 may affect the current supplied to a first LED load 130 regardless of what temperature is measured by an associated first temperature sensor 131), or is affected in aggregate by multiple temperature sensors 131 (e.g., an average temperature value of the first LED load 130 and the second LED load 130, as measured by a first temperature sensor 131 and a second temperature sensor 131 respectively, is used to affect the current provided to both LED loads 130). Additionally, when there are multiple LED loads 130, the power supplied to a given LED load 130 may be separately regulated (e.g., the power supplied to first LED load 130 may be different than the power supplied to second LED load 130) or commonly regulated (e.g., the power supplied to first LED load 130 is equal to the power supplied to second LED load 130 when power is supplied to both of the LED loads 130).

At DECISION 250, it is determined whether the operational current is below the nominal current. When the operational current is not below the nominal current, method 200 returns to OPERATION 220 to continue monitoring the heat of the LED load 130 with the present operational current being equal to the nominal current. When the operational current is below the nominal current, method 200 proceeds to OPERATION 260.

In various aspects where the operational current is adjusted in steps, the current controller 121 may set a time threshold between the determination in DECISION 230 and the determination in DECISION 250 so that a temperature fluctuating above and below the temperature threshold does not cause the current controller 121 to introduce flicker into the LED luminaire 100 as the operational current is adjusted upward and downward. A time threshold may be set via a number of clock cycles in a microprocessor between performing the operations, via an averaging of temperatures in a register, or the speed of the components in the current controller 121 (e.g., switching delays).

At OPERATION 260, the operational current is raised. As will be appreciated, the operational current may be raised in steps (e.g., 0% to 25% to 50% to 75% to 100%) or in a continuum similarly to how the operational current is reduced in OPERATION 240, but will not be raised to exceed the nominal current. Method 200 then returns to OPERATION 220 to continue monitoring the heat of the LED load 130.

Method 200 may conclude when the power source is removed, and may start again when the power source is reapplied.

Systems, devices or methods disclosed herein may include one or more of the features structures, methods, or combination thereof described herein. For example, a device or method may be implemented to include one or more of the features and/or processes above. It is intended that such device or method need not include all of the features and/or processes described herein, but may be implemented to include selected features and/or processes that provide useful structures and/or functionality.

Various modifications and additions can be made to the disclosed embodiments discussed above. Accordingly, the scope of the present disclosure should not be limited by the particular embodiments described above, but should be defined only by the claims set forth below and equivalents thereof.

We claim:

1. A light emitting diode (LED) luminaire, comprising:

an LED load, including at least one light emitting diode and at least one temperature sensor;

a driving circuit providing power to the LED load, including a current controller in communication with the at least one temperature sensor, the current controller configured to regulate an amount of power provided to the LED load in response to a temperature of the LED load measured by the at least one temperature sensor, wherein the current controller is configured to receive an indication of the temperature of the LED from the at least one temperature sensor and output signals to the driving circuit to regulate the amount of power by providing a predetermined nominal amount of power to the LED load;

decreasing the amount of power provided to the LED load below the nominal amount of power in response to the temperature of the LED load as measured by the at least one temperature sensor exceeding a predetermined high threshold temperature;

after decreasing the amount of power provided to the LED load, increasing the amount of power provided to the LED load up to the nominal amount of power in response to the temperature of the LED load measured by the at least one temperature sensor reaching a predetermined cooldown temperature and in response to the amount of power provided to the LED load being below the nominal amount of power;

wherein increasing the amount of power up to the nominal amount of power in response to the temperature reaching the predetermined cooldown temperature further comprises waiting to increase the power until a predetermined time threshold has passed after decreasing the amount of power; and wherein the predetermined time threshold is set according to at least one of a number of clock cycles in a microprocessor between determining that the temperature of the LED load as measured by the at least one temperature sensor does not exceed the predetermined high threshold temperature and determining the temperature of the LED load measured by the at least one temperature sensor has reached the predetermined cooldown temperature and the amount of power provided to the LED load is below the nominal amount of power, an averaging of a plurality of the temperatures in a register of the LED load measured by the at least one temperature sensor, or an operating speed of the current controller.

2. The LED luminaire of claim 1, further comprising a second LED load, including at least one second light emitting diode and at least one second temperature sensor, the at least one second temperature sensor in communication with the current controller for regulating a second amount of direct current power provided to the second LED load in response to changes in a second temperature associated with the second LED load.

3. The LED luminaire of claim 2, wherein the amount of power to the LED load is regulated in response to the second temperature; and wherein the second amount of direct current power provided to the second LED load is regulated in response to the temperature of the LED load.

4. The LED luminaire of claim 2, wherein the current controller regulates the power provided to the LED load and the second amount of direct current power provided to the second LED load to be equal.

5. The LED luminaire of claim 1, wherein the LED luminaire is adapted for use in a hazardous environment.

6. The LED luminaire of claim 1, wherein the at least one temperature sensor includes a thermistor.

7. The LED luminaire of claim 1, wherein the at least one temperature sensor includes a thermocouple.

8. The LED luminaire of claim 1, wherein the at least one temperature sensor includes a photodiode operable to receive infrared light.

9. The LED luminaire of claim 1, wherein the at least one temperature sensor includes a resistance temperature detector.

10. A light emitting diode (LED) luminaire, comprising:

a temperature sensor proximate to an LED load, operable to measure a temperature of the LED load;

a current controller disposed remotely from the LED load and in communication with the temperature sensor, the current controller operable to provide a predetermined nominal level of current to the LED load;

receive an indication of the temperature of the LED from the temperature sensor;

decrease the level of current provided to the LED load in response the temperature measured by the temperature sensor exceeding a predetermined high threshold temperature; and thereafter increase the level of current provided to the LED load up to the nominal current level in response the level of current provided to the LED being below the nominal current level and in response to the temperature measured by the temperature sensor reaching a predetermined cooldown temperature;

wherein increasing the amount of power up to the nominal amount of power in response to the temperature reaching the predetermined cooldown temperature further comprises waiting to increase the power until a predetermined time threshold has passed after decreasing the amount of power; and wherein the predetermined time threshold is set according to at least one of a number of clock cycles in a microprocessor between determining that the temperature of the LED load as measured by the temperature sensor does not exceed the predetermined high threshold temperature and determining the temperature of the LED load measured by the temperature sensor has reached the predetermined cooldown temperature and the amount of power provided to the LED load is below the nominal amount of power, an averaging of a plurality of the temperatures in a register of the LED load measured by the temperature sensor, or an operating speed of the current controller.

11. The LED luminaire of claim 10, wherein the temperature sensor is mounted on a printed circuit board on which LEDs comprising the LED load are mounted.

12. The LED luminaire of claim 10 further comprising, a second temperature sensor disposed of on the LED load, operable to measure a second temperature of the LED load.

13. The LED luminaire of claim 12, wherein the current controller uses a higher temperature of the temperature measured by the temperature sensor and the second temperature measured by the second temperature sensor to adjust the level of current provided to the LED load.

14. The LED luminaire of claim 12, wherein the current controller uses an algorithm based on the cumulative temperature data of the temperature measured by the temperature sensor and the second temperature measured by the second temperature sensor to adjust the level of current provided to the LED load.

15. The LED luminaire of claim 10, wherein the LED luminaire is adapted for use in a hazardous environment.

16. The LED luminaire of claim 10, wherein the temperature sensor is a thermistor.

17. A light emitting diode (LED) luminaire, comprising:

at least one LED that is provided an operating current from a power source;

a temperature sensor configured such that a resistance of the temperature sensor changes in relationship with a change in a temperature of the at least one LED, the temperature sensor provided a reference current of a predetermined value from the power source such that a voltage across the temperature sensor varies in accordance with the change in temperature of the at least one LED, while the at least one LED is provided the operating current; and a current controller in communication with the power source and the temperature sensor, the current controller operable to measure the voltage across the temperature sensor and to reduce the operating current provided from the power source to the at least one LED when the voltage reaches a predetermined high threshold temperature, and after reducing the operating current, the current controller further operable to increase the operating current provided from the power source to the at least one LED up to a predetermined nominal current level in response to the voltage reaching a predetermined cooldown temperature and the operating current being below the predetermined nominal current level; and wherein increasing the amount of power up to the nominal amount of power in response to the temperature reaching the predetermined cooldown temperature further comprises waiting to increase the power until a predetermined time threshold has passed after decreasing the amount of power; and wherein the predetermined time threshold is set according to at least one of a number of clock cycles in a microprocessor between determining that the temperature of the LED load as measured by the temperature sensor does not exceed the predetermined high threshold temperature and determining the temperature of the LED load measured by the temperature sensor has reached the predetermined cooldown temperature and the amount of power provided to the LED load is below the nominal amount of power, an averaging of a plurality of the temperatures in a register of the LED load measured by the temperature sensor, or an operating speed of the current controller.

18. The LED luminaire of claim 17, wherein the predetermined high threshold temperature is set according to an industrial standard for use of luminaires in a hazardous environment.

19. The LED luminaire of claim 17, wherein the temperature sensor is located between the power source and the at least one LED, wherein the reference current is the operating current.

20. The LED luminaire of claim 19, wherein the temperature sensor is a thermistor.

21. The LED luminaire of claim 17, wherein the reference current is a constant value current.

22. A light emitting diode (LED) luminaire, comprising:

a power source;

at least one LED that is provided an operating current from the power source;

a temperature sensor, having variable resistance at different temperatures and is part of a voltage divider circuit operated from a constant voltage; and a current controller in communication with the power source and the temperature sensor, the current controller operable to measure a voltage across the temperature sensor and to reduce the operating current provided from the power source to the at least one LED when the voltage reaches a predetermined high threshold temperature and the current controller further operable to increase the operating current provided from the power source to the at least one LED up to a nominal current level in response to the voltage reaching a predetermined cooldown threshold temperature and the operating current being below the nominal current level;

wherein increasing the amount of power up to the nominal amount of power in response to the temperature reaching the predetermined cooldown temperature further comprises waiting to increase the power until a predetermined time threshold has passed after decreasing the amount of power; and wherein the predetermined time threshold is set according to at least one of a number of clock cycles in a microprocessor between determining that the temperature of the LED load as measured by the temperature sensor does not exceed the predetermined high threshold temperature and determining the temperature of the LED load measured by the temperature sensor has reached the predetermined cooldown temperature and the amount of power provided to the LED load is below the nominal amount of power, an averaging of a plurality of the temperatures in a register of the LED load measured by the temperature sensor, or an operating speed of the current controller.

* * * * *